US009583858B2

(12) United States Patent
Hashimoto et al.

(10) Patent No.: US 9,583,858 B2
(45) Date of Patent: Feb. 28, 2017

(54) CONNECTOR TERMINAL AND CONNECTOR

(71) Applicant: Dai-ichi Seiko Co., Ltd., Kyoto-shi, Kyoto (JP)

(72) Inventors: Yoshimitsu Hashimoto, Onojo (JP); Jun Nogami, Ogori (JP); Hisashi Hamachi, Onojo (JP)

(73) Assignee: DAI-ICHI SEIKO CO., LTD., Kyoto-Shi, Kyoto (JP)

( * ) Notice: Subject to any disclaimer, the term of this patent is extended or adjusted under 35 U.S.C. 154(b) by 0 days.

(21) Appl. No.: 15/140,405

(22) Filed: Apr. 27, 2016

(65) Prior Publication Data

US 2016/0322732 A1 Nov. 3, 2016

(30) Foreign Application Priority Data

Apr. 30, 2015 (JP) ..... 2015-093228

(51) Int. Cl.
*H01R 13/40* (2006.01)
*H01R 13/41* (2006.01)
*H01R 13/04* (2006.01)

(52) U.S. Cl.
CPC ..... *H01R 13/41* (2013.01); *H01R 13/04* (2013.01)

(58) Field of Classification Search
CPC ..... H01R 13/04; H01R 13/41; H01R 12/585; H01R 12/58; H01R 12/716
USPC ..... 439/444, 733.1, 751, 82
See application file for complete search history.

(56) References Cited

U.S. PATENT DOCUMENTS 4,698,026 A * 10/1987 Rolf ..... H01R 12/58 439/751
4,735,575 A * 4/1988 Shaffer ..... H01R 12/585 439/751
4,878,861 A 11/1989 Kendall et al.
5,035,656 A * 7/1991 Patel ..... H01R 12/58 439/733.1
5,897,401 A * 4/1999 Fili ..... H01R 13/41 411/451.1
6,042,429 A * 3/2000 Bianca ..... H01R 13/41 439/733.1

FOREIGN PATENT DOCUMENTS

JP 3154117 B 2/2001
JP 2014203627 10/2014

* cited by examiner

*Primary Examiner* — Xuong Chung Trans
(74) *Attorney, Agent, or Firm* — Howard & Howard Attorneys PLLC

(57) ABSTRACT

A connector terminal includes a conductive bar-shape member, a plurality of concavities each formed as a groove provided in an outer circumference of the bar-shape member, extending in a lengthwise direction of the bar-shape member, and spreading toward an opening from a bottom, and a convexity formed between the adjoining concavities. A first surface is formed on the bottom of the concavity. A second surface and a third surface that form different inclination angles relative to a depthwise direction of the concavity are alternately formed on an internal wall surface of the concavity from the bottom toward the opening.

12 Claims, 19 Drawing Sheets

CONNECTOR TERMINAL AND CONNECTOR

CROSS-REFERENCE TO RELATED APPLICATION

This application claims the benefit of Japanese Patent Application No. 2015-093228, filed on Apr. 30, 2015, the entire disclosure of which is incorporated by reference herein.

FIELD

This application relates generally to a connector terminal and a connector.

BACKGROUND

A connector terminal that is fitted in so as to pass completely through the housing of an electrical connector is formed with a plurality of concavities in the outer circumference of a bar-shape member so as to prevent a pull-out of the connector terminal from the housing. Such concavities are formed by depressing the outer circumference of the conductive bar-shape member by a tapered punch. A portion between the adjoining concavities is to be engaged with the internal surface of the housing. Unexamined Japanese Patent Application Kokai Publication No. 2014-203627 discloses such a connector terminal.

The connector terminal disclosed in Unexamined Japanese Patent Application Kokai Publication No. 2014-203627 includes, as illustrated in FIGS. 20 and 21, an engage portion 2 and a correction portion 3. The engage portion 2 is to be in contact with, with pressure being applied, the internal wall surface of an unillustrated holding hole which has a rectangular cross-sectional shape and which is formed in the housing. The correction portion 3 is provided at the front side relative to the engage portion 2 in the axial direction (at −Y side). The correction portion 3 is utilized to align the lengthwise direction of a terminal portion 1 (the same direction as a Y-axis direction) with the lengthwise direction of the holding hole (the same direction as the Y-axis direction). The correction portion 3 has an X-cross-sectional shape that is to contact the internal surface of the holding hole across a certain length. Four protrusions 7 that form the X-cross-sectional shape extend in the Y-axis direction. The external edge of the protrusion 7 is in parallel with the external edge of the terminal portion 1. According to the connector terminal employing the above structure, when the correction portion 3 is press-fitted in the holding hole of the housing, the protrusion 7 slightly bites into the corner of the holding hole while being aligned with the corner of the holding hole in the rectangular cross-sectional shape. Hence, the direction of the connector terminal and the entering posture thereof are corrected.

The engage portion 2 in contact with the internal wall surface of the holding hole of the housing includes engagement pieces 4*a*, 4*b* divided in the Y-axis direction of the terminal portion 1. The engagement pieces 4*a*, 4*b* have respective uniform XZ cross-sections that are symmetrical when viewed from the fit-in direction. Respective side faces of the engagement pieces 4*a*, 4*b* at +X side and at −X side are formed with V-grooves 5*a*, 5*b* across the whole lengths of the engagement pieces 4*a*, 4*b*.

According to the connector terminal disclosed in Unexamined Japanese Patent Application Kokai Publication No. 2014-203627, since the V-grooves 5*a*, 5*b* are formed in the side faces of the engagement pieces 4*a*, 4*b* at +X side and at −X side, the thickness of the engagement pieces 4*a*, 4*b* at the corner is quite thin. Hence, the amount of bit-in by the engagement pieces 4*a*, 4*b* to the housing is little. Accordingly, the holding force of the connector terminal relative to the housing is weak, and when excessive pull-out force is applied to the connector terminal, the connector terminal may be pulled out.

Conversely, according to a connector terminal illustrated in FIG. 22, a concavity 20 formed in the outer circumference of a bar-shape member B0 in a square bar shape is formed as a V-groove that has an angle q1 of 90 degrees. Hence, the thickness of an engage portion 310 becomes substantially uniform from the basal end to the front end. Accordingly, the sufficient amount of bite-in by the engage portion 310 to a housing can be ensured. Consequently, the holding force of the connector terminal relative to the housing can be improved.

However, in order to form such an engage portion 310, when the outer circumference of a bar-shape member to which plating is applied is depressed by a punch that has an angle of the front end which is 90 degrees, when the front end of the punch bites in the bar-shape member, the plating is likely to be peeled off. In addition, together with the advancement of the depression by the punch, the tapered punch deeply bites into the bar-shape member. This gradually peels off the plating while pushing and spreading the concavity 20. Therefore, the plating peeled pieces are accumulated on the punch.

Hence, when the punch is applied multiple times to produce the connector terminal, a large amount of plating peeled pieces may be accumulated on the inclined face of the punch, and a cleaning work to eliminate the accumulated plating from the punch is necessary in this case. When a cleaning work for the punch is carried out, the production of the connector terminal should be suspended.

The amount of plating peeled piece accumulated on the inclined face of the punch gradually increases from the front end of the punch toward the basal end thereof. Hence, the accumulated plating peeled pieces are formed in a shape like a thin and elongated string along the lengthwise direction of the connector terminal. In this case, the string-like plating peeled pieces may stride over the adjoining connector terminals, causing a short-circuit of the connector terminals.

When the concavities are formed by a punch that has an angle of the front end which is larger than 90 degrees, since such a punch depresses a plating so as to hold down the plating, a peeling of the plating can be suppressed. For example, by forming the concavities 20 formed as a V-groove that has an angle q2 of 120 degrees by a punch which has the angle of the front end that is 120 degrees, a peeling of the plating can be suppressed. In this case, however, the thickness of an engage portion 320 (engage portion 320 indicated by dashed lines in FIG. 22) gradually becomes thin from the basal end toward the front end. Accordingly, the holding force of the connector terminal relative to the housing may decrease.

SUMMARY

The present disclosure has been made in view of the foregoing circumstances, and an objective of the present disclosure is to provide a connector terminal and a connector that can be efficiently produced while a reduction of holding force relative to a housing is suppressed.

In order to accomplish the above objective, a connector terminal according to a first aspect of the present disclosure includes:

a conductive bar-shape member;

a plurality of concavities each formed as a groove provided in an outer circumference of the bar-shape member, extending in a lengthwise direction of the bar-shape member, and spreading toward an opening from a bottom; and a convexity formed between the adjoining concavities, in which:

a first surface is formed on the bottom of the concavity; and a second surface and a third surface that form different inclination angles relative to a depthwise direction of the concavity are alternately formed on an internal wall surface of the concavity from the bottom toward the opening.

When, in a cross-section of the concavity orthogonal to the lengthwise direction of the bar-shape member, a parallel straight line to the depthwise direction of the concavity is defined as a virtual reference line:

an angle between the first surface and the virtual reference line may be greater than 45 degrees and equal to or smaller than 90 degrees;

an angle between the second surface and the virtual reference line may be equal to or greater than zero degree and equal to or smaller than 45 degrees; and an angle between the third surface and the virtual reference line may be greater than 45 degrees and equal to or smaller than 90 degrees.

The first surface may be a concaved circular arc surface, a flat surface that forms an angle of 90 degrees relative to the virtual reference line, or a flat surface inclined relative to the virtual reference line.

The internal wall surface of the concavity may be a parallel surface to the lengthwise direction of the bar-shape member.

The internal wall surface of the concavity may be an orthogonal surface to the lengthwise direction of the bar-shape member.

The second surface may be connected to the first surface.

An area of the second surface may be smaller than an area of the third surface.

The bar-shape member may be formed in a polygonal cross-sectional shape.

The bar-shape member may be formed in a circular cross-sectional shape.

The concavity may be formed in a position that equally divides a circumference.

A connector according to a second aspect of the present disclosure includes:

a housing formed with a connector terminal housing space; and the connector terminal according to the first aspect of the present disclosure disposed in the connector terminal housing space, in which the connector terminal allows the convexity to be engaged with an internal surface of the housing, thereby being fastened to the connector terminal housing space.

The convexity may bite in the internal surface of the housing, thus being fastened.

BRIEF DESCRIPTION OF THE DRAWINGS

A more complete understanding of this application can be obtained when the following detailed description is considered in conjunction with the following drawings, in which.

DETAILED DESCRIPTION

First Embodiment

Figure 1:
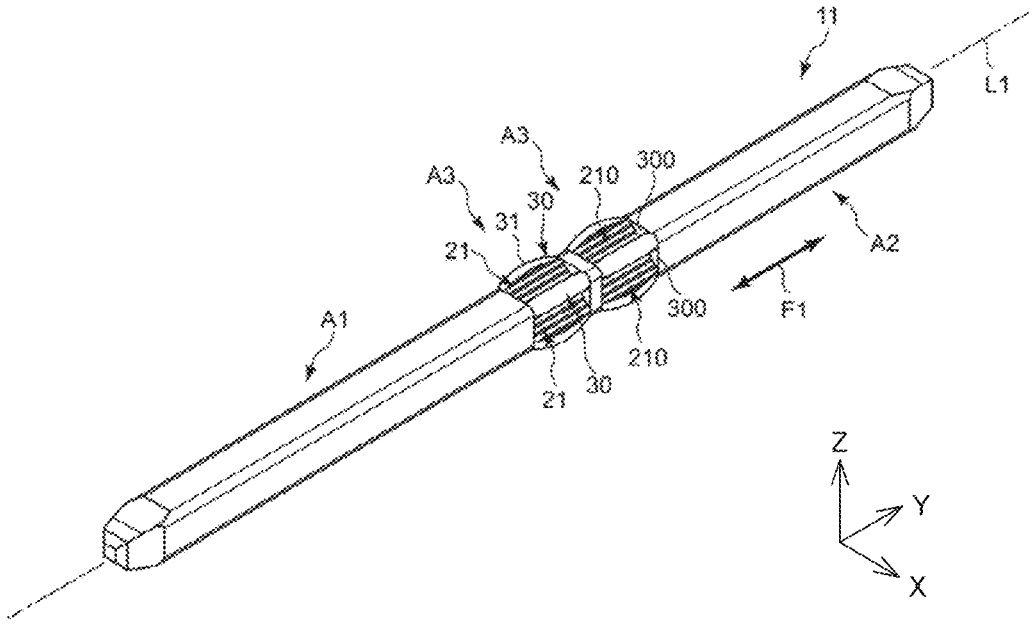
FIG. 1 is a perspective view illustrating a connector terminal according to a first embodiment of the present disclosure.

A connector terminal according to a first embodiment of the present disclosure will be explained with reference to FIGS. 1-7A, 7B. In order to facilitate understanding, an XYZ coordinate system is set up and referred as needed. As illustrated in FIG. 1, a connector terminal 11 is a male terminal that is utilized as an electrical connector which is fitted in an unillustrated housing so as to pass completely therethrough. The electrical connector includes the connector terminal 11 and the housing, and is mounted on an unillustrated printed wiring board.

The connector terminal 11 includes a bar-shape member that has a lengthwise direction F1 as an elongated direction, a plurality of concavities 21 provided in the bar-shape member, and a plurality of engage portions 30 (convexities). The bar-shape member is a conductive member having a plating applied on the outer circumference. The bar-shape member of the connector terminal 11 illustrated in FIG. 1 is a metal bar formed in a square bar shape.

Figure 2:
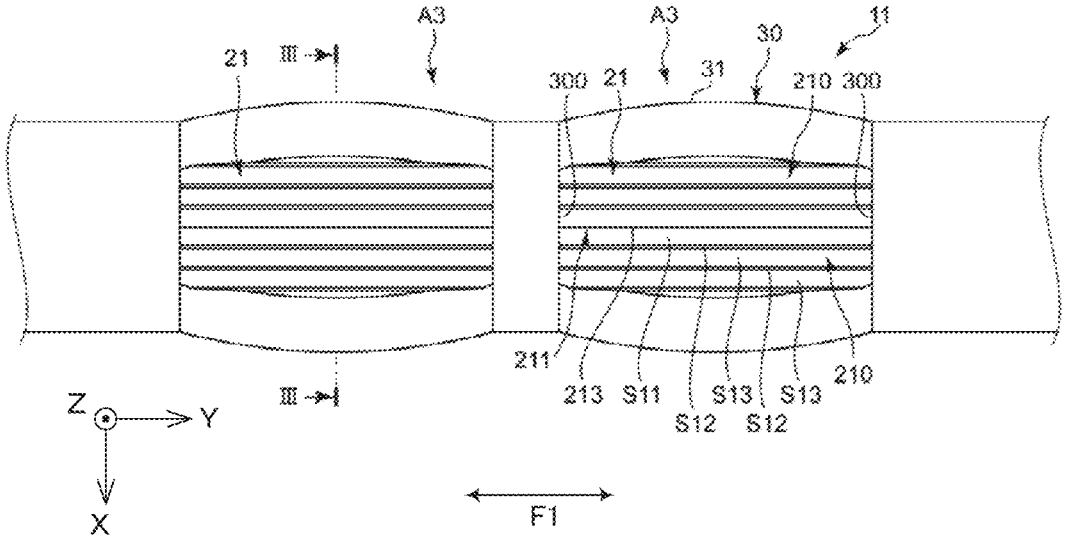
FIG. 2 is a plan view illustrating a portion of the connector terminal in an enlarged manner.

The connector terminal 11 is formed with a contact area A1, a mount area A2, and an engage area A3. The contact area A1 is to be in contact with a female terminal that is a connection target. The mount area A2 is to be in contact with the through hole of the printed wiring board. The engage area A3 is provided between the contact area A1 and the mount area A2. In the first embodiment, as illustrated in FIG. 2, the two engage areas A3 are provided along the lengthwise direction F1. However, the number of engage areas A3 is optional. At least one engage area A3 should be provided.

Figure 3:
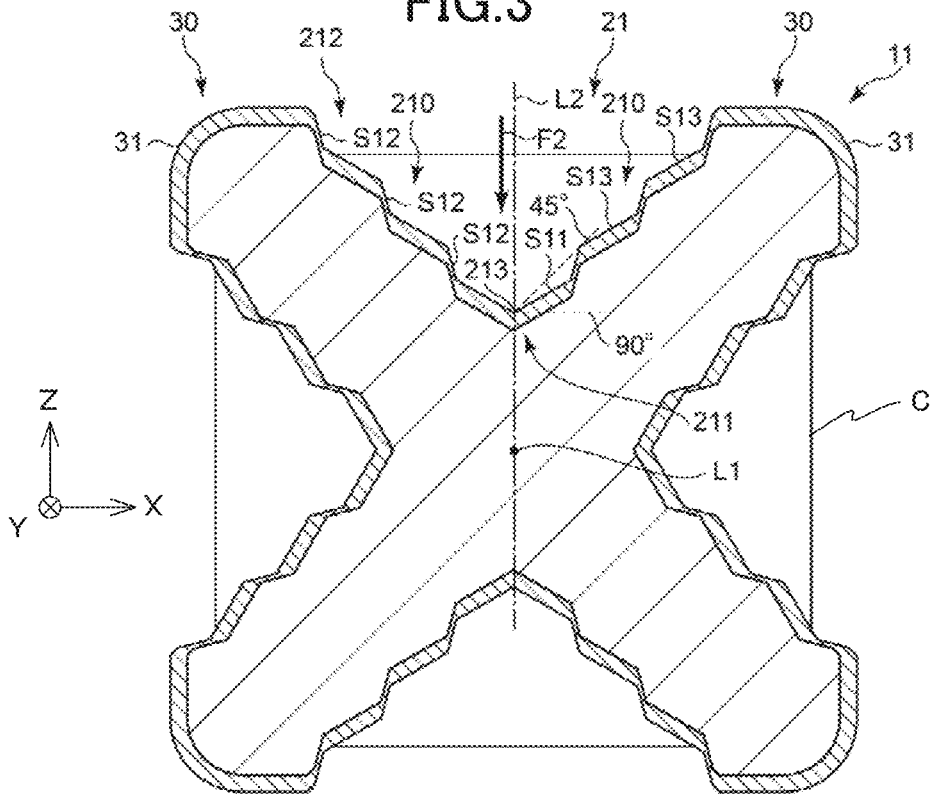
FIG. 3 is a cross-sectional view taken along a line in FIG. 2.

As illustrated in FIG. 3, the concavities 21 are formed in the engage area A3 at an equal pitch along the circumference around an axial line L1 of the bar-shape member. The XZ cross-section of the bar-shape member in the first embodiment is in a square shape. Hence, the four concavities 21 are formed in respective surfaces around the axial line L1 of the bar-shape member.

The engage portion 30 (convexity) is provided between the adjoining concavities 21 along the circumference around the axial line L1. When viewed in the axial-line-L1 direction, a protrusion 31 that protrudes from an outer circumference C including the contact area A1 and the mount area A2 is formed.

As illustrated in FIGS. 1, 2, the concavity 21 is formed with a bottom 211, two internal wall surfaces 210 facing with each other, and two internal wall surfaces 300 facing with each other.

The internal wall surface 210 is a parallel plane to the lengthwise direction F1. As illustrated in FIG. 3, the internal wall surfaces 210 facing with each other are formed so as to have the pitch therebetween becoming widespread toward an opening 212 from the bottom 211. A plurality of steps is formed on the internal wall surface 210.

The internal wall surface 300 is an orthogonal plane to the lengthwise direction F1, and is also a parallel plane to the XZ cross-section.

In this case, a plurality of steps formed on the internal wall surface 210 will be explained in detail.

As illustrated in FIGS. 2, 3, a first surface S11 is formed on the bottom 211 of the concavity 21. In addition, a second surface S12 and a third surface S13 are alternately formed on the internal wall surface 210 of the concavity 21 from the bottom 211 toward the opening 212. The second surface S12 and the third surface S13 formed alternately construct the step.

In the XZ cross-section of the concavity 21 orthogonal to the internal wall surface 210 of the concavity 21 illustrated in FIG. 3, when a straight line in a depthwise direction F2 toward the deepest portion of the concavity 21 is defined as a virtual reference line L2, in the case of FIG. 3, the deepest portion of the concavity 21 is a groove bottom 213. Note that the pair of internal wall surfaces 210 facing with each other is formed symmetrical relative to the virtual reference line L2 that becomes a symmetrical axis. In addition, the virtual reference line L2 intersects the axial line L1.

As illustrated in FIG. 3, the first surface S11 is an inclined flat surface that forms an angle of 60 degrees relative to the virtual reference line L2. The angle between the first surface S11 and the virtual reference line L2 is 60 degrees in this embodiment, but the present disclosure is not limited to this specific value. The angle between the first surface S11 and the virtual reference line 2 may be greater than 45 degrees and equal to or smaller than 90 degrees.

The second surface S12 is an inclined flat surface that forms an angle of 15 degrees relative to the virtual reference line L2. The angle between the second surface S12 and the virtual reference line L2 is 15 degrees in this embodiment, but the present disclosure is not limited to this specific value. The angle between the second surface S12 and the virtual reference line L2 may be equal to or greater than 0 degree and equal to or smaller than 45 degrees.

The third surface S13 is an inclined flat surface that forms an angle of 60 degrees relative to the virtual reference line L2. The angle between the third surface S13 and the virtual reference line L2 is 60 degrees in this embodiment, but the present disclosure is not limited to this specific value. The angle between the third surface S13 and the virtual reference line L2 may be equal to or greater than 45 degrees, and equal to or smaller than 90 degrees.

In addition, the second surface S12 has a shorter length in the inclination direction and in the XZ cross-section than those of the first and third surfaces S11, S13 in the respective inclination directions. Hence, the second surface S12 has a smaller area than those of the first and third surfaces S11, S13.

A production method of the connector terminal 11 employing the above structure according to the first embodiment will be explained with reference to FIGS. 4-7A.

Figure 4:
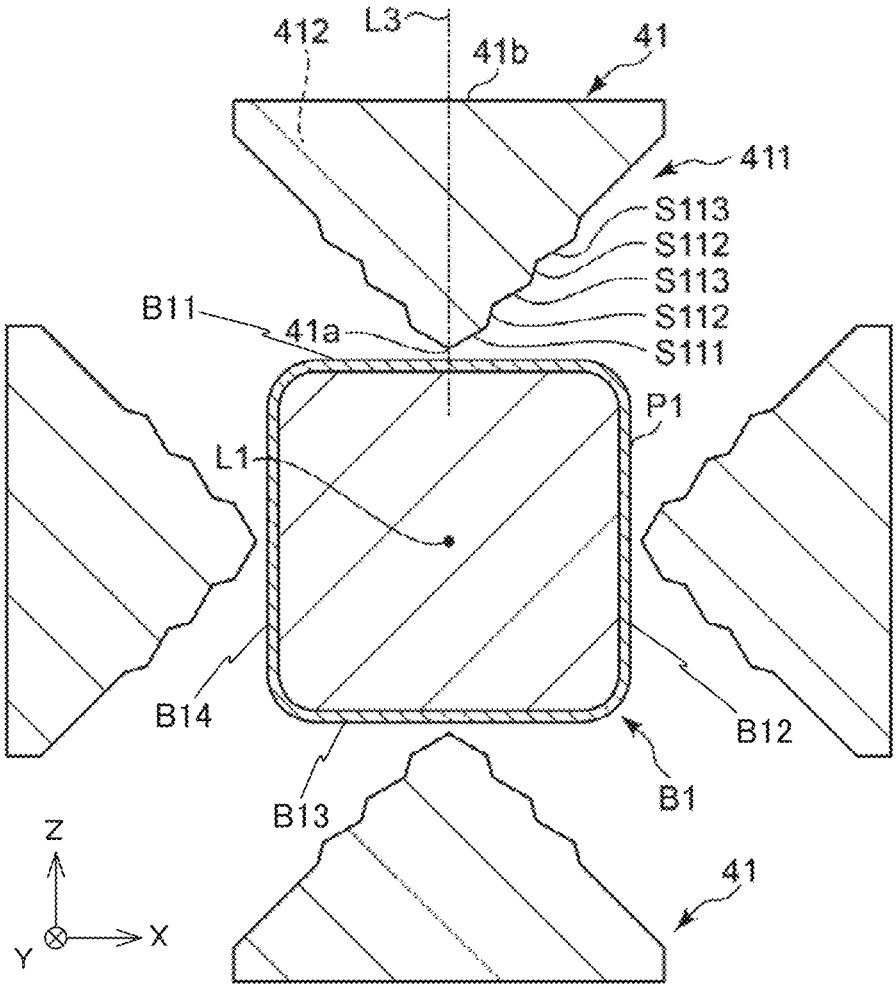
FIG. 4 is a (first) cross-sectional view for explaining a production method of the connector terminal according to the first embodiment, and is a cross-sectional view with punches being disposed around a bar-shape member.

As illustrated in FIG. 4, four punches 41 each formed in a tapered shape are disposed so as to face the respective surfaces (upper face B11, side faces B12, and lower face B13) of the bar-shape member B1 in the square bar shape around the axial line L1.

In this case, the shape of the punch 41 will be explained. The punch 41 is a member that has the lengthwise direction which is the axial line L1 (Y-axis direction) of the bar-shape member B1. The punch 41 has an inclined face 411 and an end face 412. The inclined face 411 is formed so as to incline and become widespread toward a basal end portion 41*b* of the punch 41 from a front end portion 41*a* thereof. Steps that form the internal wall surface 210 of the concavity 21 illustrated in FIG. 3 are formed in the inclined face 411. In addition, the end face 412 is an orthogonal plane to the axial line L1 (Y-axis direction). The end face 412 is also a parallel plane to the XZ cross-section. The end face 412 is utilized to form the internal wall surface 300 of the concavity 21 illustrated in FIG. 3.

The step formed in the inclined face 411 includes a first surface S111 formed adjacent to the front end portion 41*a*, and a second surface S112 and a third surface S113 formed alternately. The first surface S111 is utilized to form the first surface S11 of the concavity 21 (see FIG. 3). Likewise, the second surface S112 is utilized to form the second surface S12 of the concavity 21, while third surface S112 is utilized to form the third surface S13 of the concavity 21.

When a bisector that divides the angle of the front end portion 41*a* equally is defined as a virtual reference line L3, the punch 41 is formed so as to be symmetrical relative to the virtual reference line L3 as a symmetrical axis.

Figure 5A:
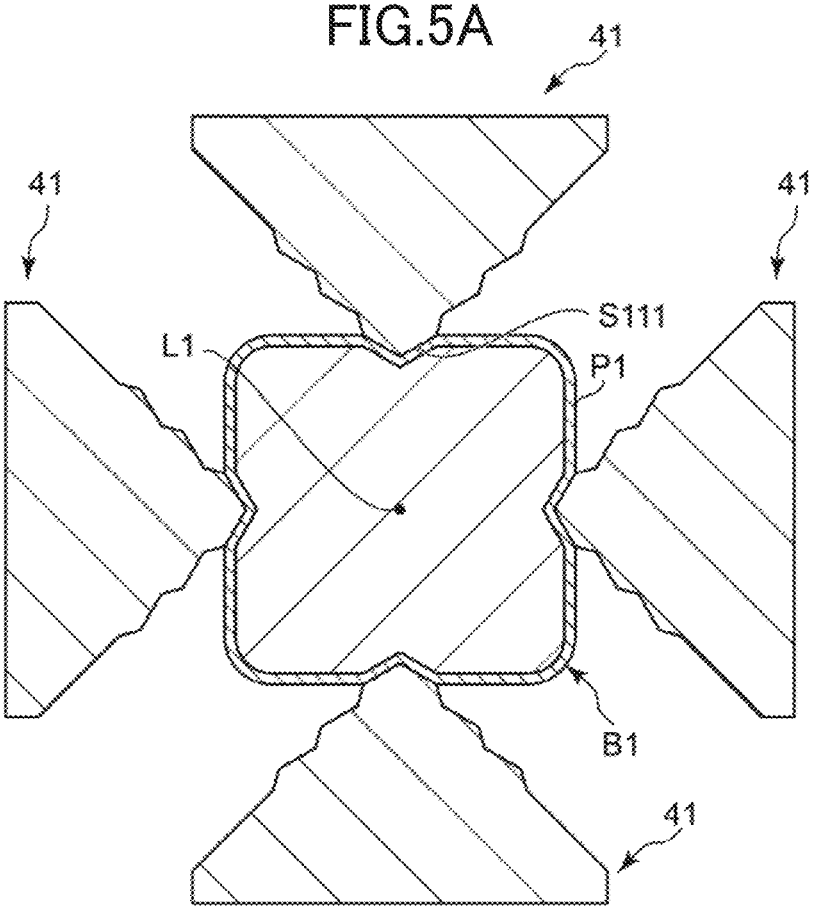
FIG. 5A is a (second) cross-sectional view for explaining the production method of the connector terminal according to the first embodiment, and is a cross-sectional view with a first surface of the punch holding down a plating of the bar-shape member.
Figure 5B:
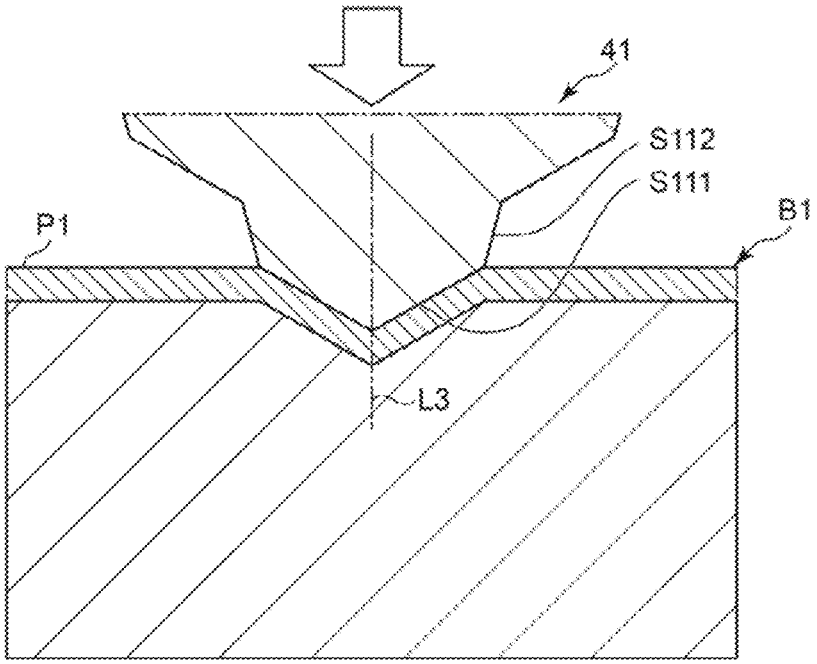
FIG. 5B is a partial enlarged cross-sectional view of FIG. 5A.

As illustrated in FIGS. 5A and 5B, the respective front end portions 41*a* of the punch 41 are depressed against a plating P1 toward the axial line L1 of the bar-shape member B1. At this time, the front end portion 41*a* of the punch 41 is depressed against the plating P1 so as to have the vertical virtual reference line L3 to each surface of the bar-shape member B1. Hence, the virtual reference line L3 of the punch 41 and the virtual reference line L2 set for the concavity 21 are aligned with each other.

The first surface S111 formed on the front end portion 41*a* of the punch 41 is an inclined flat surface that forms an angle of 60 degrees relative to the virtual reference line L3. That is, the first surface S111 is a relatively gradual inclined face relative to the XY plane. Hence, the first surface S111 functions as a hold-down surface that holds down the plating P1 so as to suppress a peeling of the plating P1. Accordingly, although the front end portion 41*a* of the punch 41 bites into the bar-shape member B1, no peeling of the plating P1 occurs, and the plating P1 is pushed in toward the axial line L1 of the bar-shape member B1 together with the front end portion 41*a*.

Figure 6A:
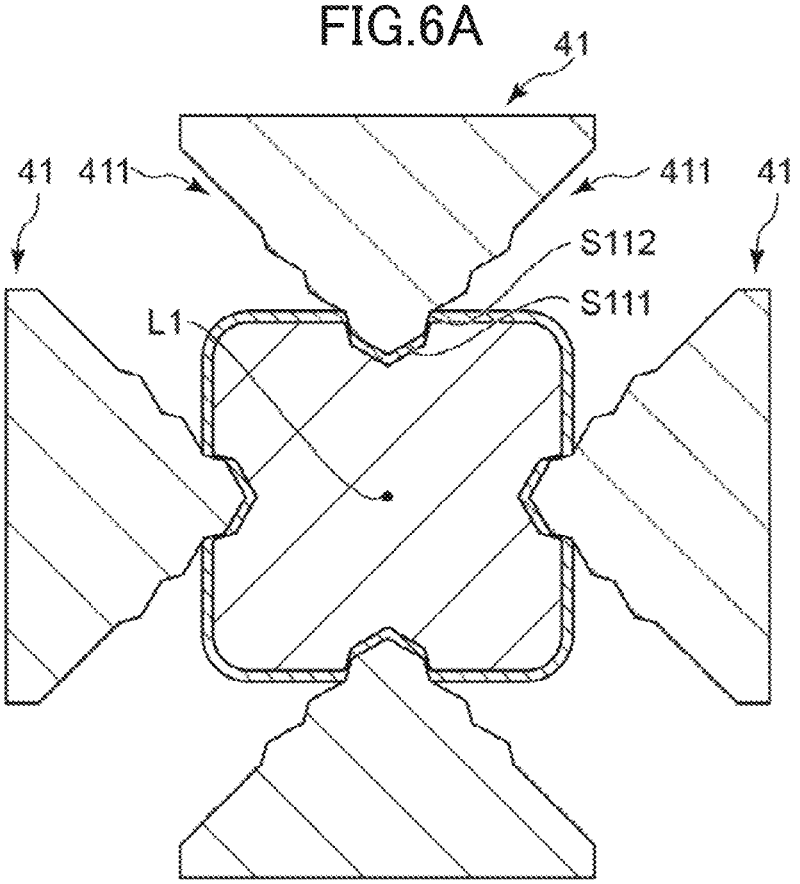
FIG. 6A is a (third) cross-sectional view for explaining the production method of the connector terminal according to the first embodiment, and is a cross-sectional view with a second surface of the punch holding down the plating of the bar-shape member.
Figure 6B:
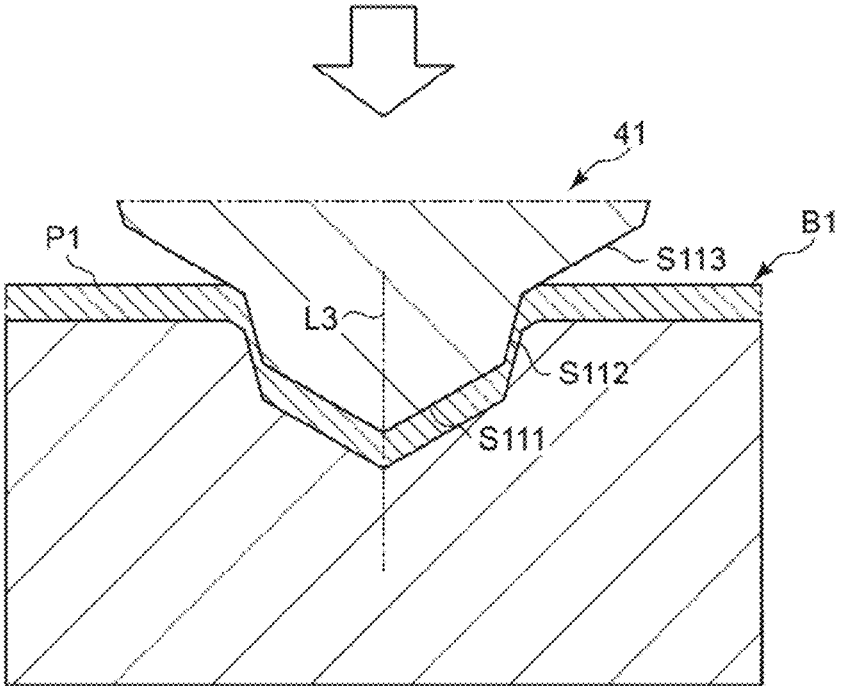
FIG. 6B is a partial enlarged cross-sectional view of FIG. 6A.

Next, as illustrated in FIGS. 6A and 6B, the second surface S112 of the punch 41 starts depressing the plating P1 of the bar-shape member B1. The second surface S112 is an inclined flat surface that forms an angle of 15 degrees relative to the virtual reference line L3. That is, the second surface S112 is a relatively keen inclined face relative to the XY plane. Accordingly, when the second surface S112 depresses the plating P1, the second surface S112 of the punch 41 deeply bites in the bar-shape member B1.

Since the second surface S12 is a keener inclined face than the first surface S11, thinning of the engage portion 30 can be suppressed.

In addition, when, for example, the second surface S112 of the punch 41 deeply bites in the bar-shape member B1, a part of the plating P1 pushed in by the first surface S111 may be cut and peeled off. The peeled pieces of plating P1 are accumulated while the second surface S112 bites in the bar-shape member B1. Hence, since no plating piece is accumulated across the whole inclined face 411 of the punch 41, the amount of accumulated peeled pieces of plating P1 can be made little by the second surface S112.

Next, the third surface S113 of the punch 41 depresses the plating P1 of the bar-shape member B1. The third surface S113 of the punch 41 is an inclined flat surface that forms an angle of 60 degrees relative to the virtual reference line L3. That is, the third surface S113 is a relatively gentle inclined face to the XY plane. Hence, the third surface S113 functions as a hold-down surface that holds down the plating P1 so as to suppress a peeling of the plating P1. Accordingly, when the third surface S113 depresses the plating P1, the front end portion 41*a* is pushed in together with the plating P1 with the third surface S113 suppressing a peeling of the plating P1. In addition, the third surface S113 is capable of suppressing a peeling of the plating caused by the depression of the second surface S112.

Figure 7A:
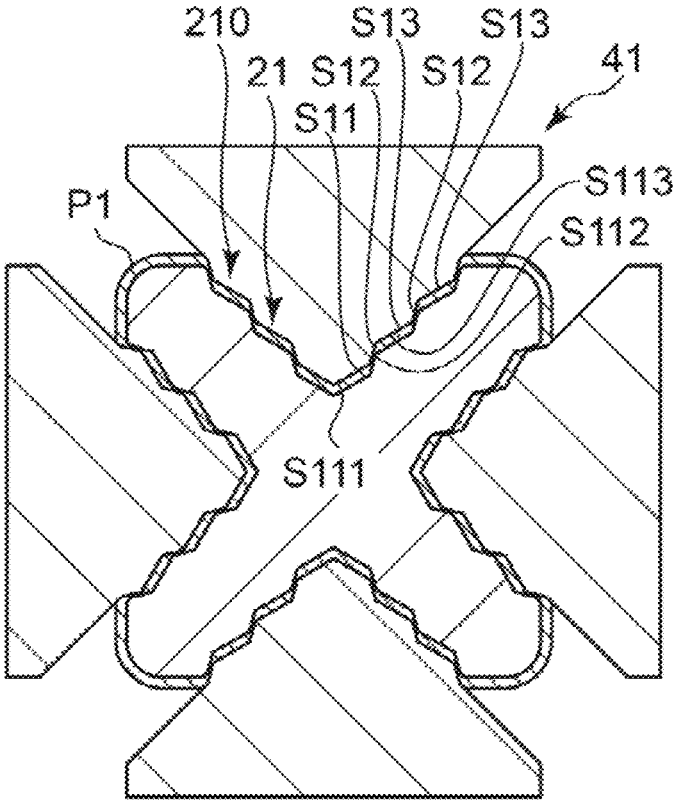
FIG. 7A is a (fourth) cross-sectional view for explaining the production method of the connector terminal according to the first embodiment, and is a cross-sectional view with a depression by the punch against the bar-shape member being completed.

Next, the second surface S112 of the punch 41 depresses the plating P1 on the bar-shape member B1. By sequentially repeating the depression by the second surface S112 and the depression by the third surface S113, as illustrated in FIG. 7A, the concavity 21 is formed in the bar-shape member B1. In addition, the first surface S11, the second surface S12, and the third surface S13 are formed on the internal wall surface 210 of the concavity 21 corresponding to the first surface S111, second surface S112, and third surface S113 of the punch 41, respectively.

As explained above, according to the first embodiment, the first surface S11 is formed on the bottom 211 of the concavity 21, while the third surface S13 is formed on the internal wall surface 210 of the concavity 21. The first and third surfaces S11 and S13 are each a gentle inclined face that serves as a hold-down surface for the plating P1 while suppressing a peeling of the plating P1. Hence, an accumulation of a large amount of scraped plating P1 on the inclined face 411 of the punch 41 is suppressed. Consequently, the connector terminal 11 and a connector including the same can be produced efficiently.

More specifically, the first surface S11 that is a gentle surface functions as the hold-down surface for the plating P1 while suppressing a peeling of the plating P1. In addition, by the depression by the second surface S12 that is the inclined face with a smaller inclination angle than that of the first surface S11, even if the plating P1 is elongated and thinned, and is peeled, the third surface S13 functions as the hold-down surface that holds down the plating P1 while suppressing a peeling of the plating P1. Hence, no plating P1 is peeled subsequently from the second surface S12. Accordingly, an accumulation of a large amount of scraped plating P1 on the inclined face 411 of the punch 41 is suppressed. Consequently, a frequent cleaning work for the punch 41 is unnecessary. Therefore, the connector terminal 11 and the connector including the same can be produced efficiently.

In addition, according to the first embodiment, in addition to the third surface S13, the second surface S12 is formed on the internal wall surface 210 of the concavity 21. This second surface S12 is a keener inclined face than the first surface S11 and the third surface S13. Hence, the engage portion 30 is ensured to have a sufficient thickness, allowing the engage portion 30 to bite in the housing sufficiently. Therefore, a reduction of the holding force of the connector terminal 11 relative to the housing can be suppressed.

Still further, since the second surface S12 and the third surface S13 are formed on the internal wall surface 210 of the concavity 21, a peeling of the plating P1 can be suppressed while allowing the engage portion 30 to have an ensured thickness. Consequently, the connector terminal 11 and the connector including the same can be efficiently produced while suppressing a reduction of the holding force relative to the housing.

Figure 7B:
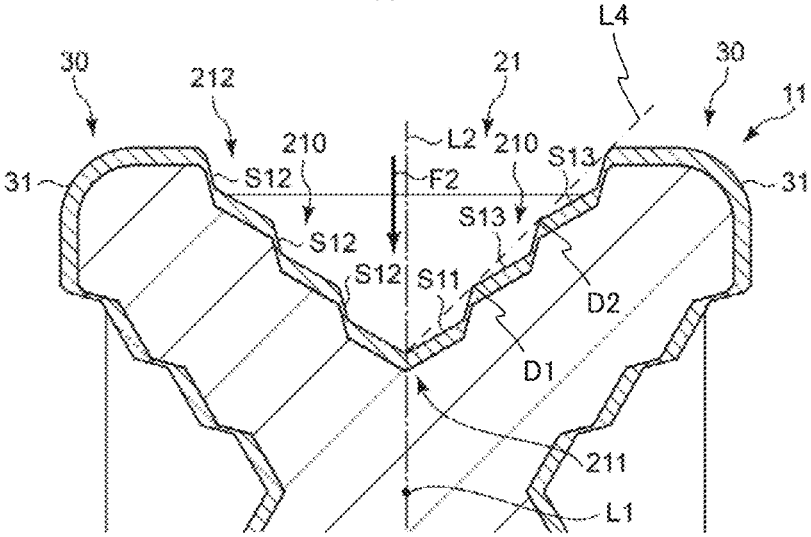
FIG. 7B is a diagram for explaining an effect of the connector terminal according to the first embodiment.

In particular, as illustrated in FIG. 7B, a straight line L4 that interconnects an end side D1 of the second surface S12 connected to the first surface S11 at the opening-212 side and an end side D2 of the second surface S12 connected to the third surface S13 at the opening-212 side should preferably be formed so as to have an angle of 45 degrees relative to the virtual reference line L2.

As explained above, the connector terminal 11 is capable of maintaining the holding force relative to the housing while suppressing an accumulation of the plating peeled piece on the punch 41. Hence, the number of maintenance works for the punch 41 can be reduced, and thus the connector terminal 11 can be produced efficiently. In addition, since an accumulation of the plating peeled piece on the punch 41 can be suppressed, when the connector terminal 11 is fitted in so as to pass completely through the housing, a short-circuit between the adjoining connector terminals 11 caused by the plating peeled piece is preventable. Therefore, the connector terminal 11 can have the improved reliability.

In addition, according to the first embodiment, the second surface S12 is formed so as to have a shorter length in the inclination direction than that of the third surface S13 in the inclination direction. Hence, the second surface S12 can make the plating P1 thinned and elongated, and also reduced the peeled length of the plating P1.

Still further, according to the first embodiment, the internal wall surface 210 is a parallel plane to the lengthwise direction F1 of the bar-shape member B1. Hence, when the concavity 21 is formed using the punch 41, a plating peeled piece produced when the plating is peeled in the orthogonal direction to the lengthwise direction F1 of the bar-shape member B1 can be suppressed.

Second Embodiment

A connector terminal according to a second embodiment of the present disclosure will be explained with reference to FIGS. 8A-10C. In order to facilitate understanding, an XYZ coordinate system is set up and referred as needed.

The connector terminal of the second embodiment differs from the first embodiment in that the first surface is formed as a concaved circular arc surface.

Figure 8A:
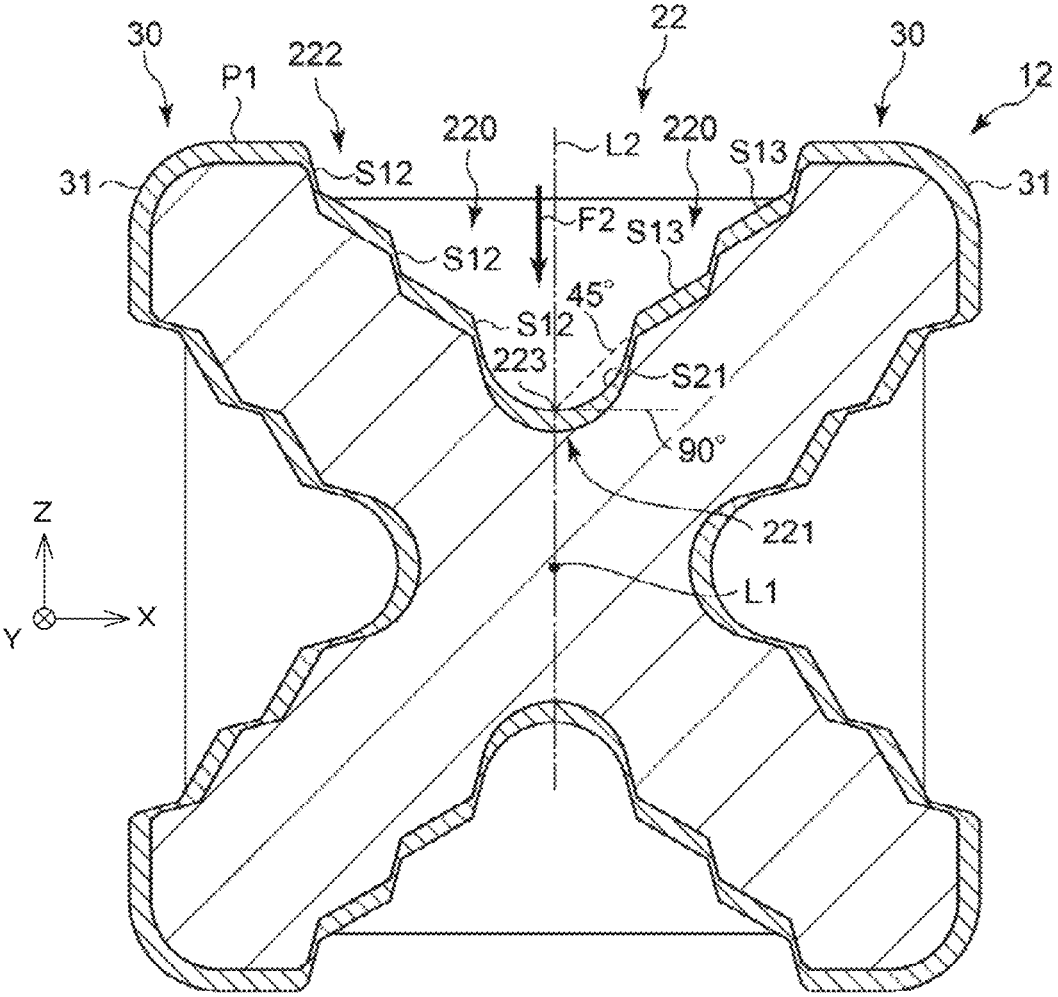
FIG. 8A is a (first) cross-sectional view of a connector terminal according to a second embodiment of the present disclosure.
Figure 8B:
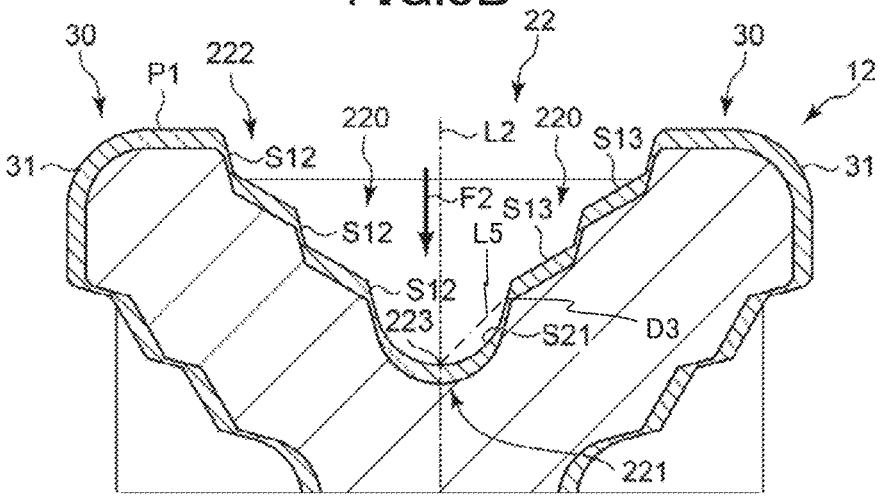
FIG. 8B is a (second) cross-sectional view of the connector terminal according to the second embodiment of the present disclosure.

As illustrated in FIGS. 8A-8C, a first surface S21 that becomes a bottom 221 of an internal wall surface 220 is formed in a concavity 22 of a connector terminal 12. This first surface S21 will be explained below in detail.

Like the first embodiment, in the orthogonal XZ cross-section of the concavity 22 to the internal wall surface 220 of the concavity 22, a straight line toward the deepest portion of the concavity 22 in the depthwise direction F2 is defined as the virtual reference line L2. In the case of the internal wall surface 220 illustrated in FIGS. 8A-8C, the deepest portion is a groove bottom 223. Note that the concavity 22 has the internal wall surfaces 220 facing with each other and symmetrical relative to the virtual reference line L2 as a symmetrical axis. The depthwise direction F2 is the line directed toward the axial line L1, and the virtual reference line L2 intersects the axial line L1.

As illustrated in FIGS. 8A-8C, a straight line L5 that interconnects the groove bottom 223 and an end side D3 of the first surface S21 at an opening-222 side is formed so as to have an angle of, relative to the virtual reference line L2, equal to or greater than 45 degrees and equal to or smaller than 90 degrees.

Like the first embodiment, the second surface S12 is connected to the first surface S21. In the second surface S12, the third surface S13 is provided so as to extend from the second surface S12. In addition, the second surface S12 and the third surface S13 are formed alternately toward the opening 222 of the concavity 22.

Figure 9:
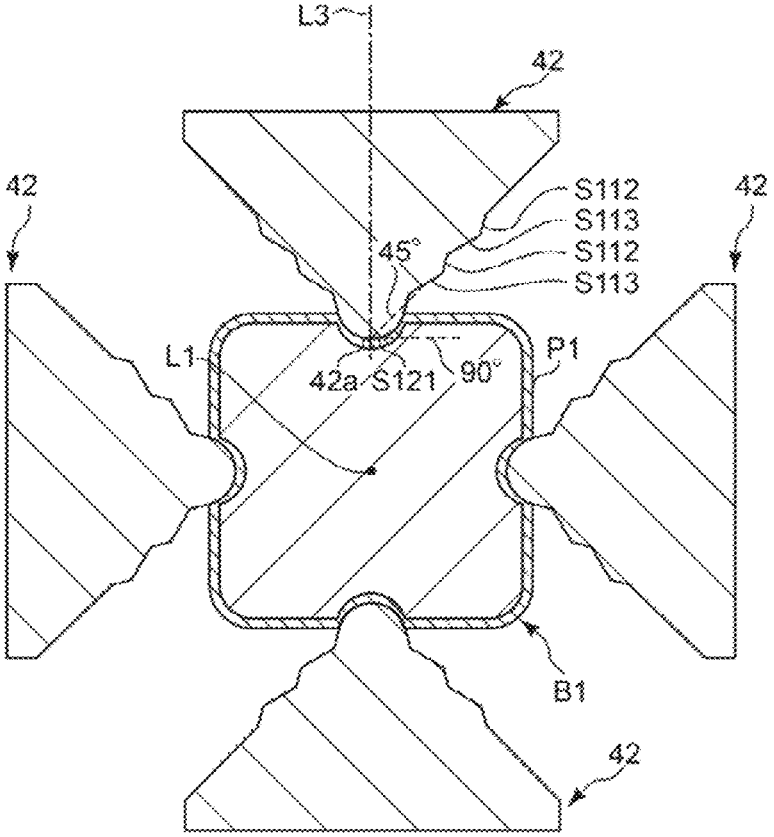
FIG. 9 is a cross-sectional view for explaining the production method of the connector terminal according to the second embodiment, and is a cross-sectional view with a first surface of a punch holding down a plating of a bar-shape member.

The concavity 22 is formed by a punch 42 illustrated in FIG. 9.

The punch 42 is formed with a first surface S121 to form the first surface S21 of the concavity 22. This first surface S121 is a protruding circular arc surface formed so as to have and angle of greater than 45 degrees and equal to or smaller than 90 degrees relative to the virtual reference line L3 that is a bisector which divides the angle of a front end portion 42*a* of the punch 42 equally. Note that since the first surface S121 is a protruding circular arc surface, the virtual reference line L3 becomes the vertical bisector to a tangent line contacting the front end portion 42*a*.

Using such a punch 42, the front end portion 42*a* is depressed toward the axial line L1 of the bar-shape member B1 in such a way that the virtual reference line L3 becomes vertical to each surface around the axial line L1 of the bar-shape member B1, thereby being depressed against the plating P1. This aligns the virtual reference line L3 of the punch 42 with the virtual reference line L2 set for the concavity 22.

Figure 10A:
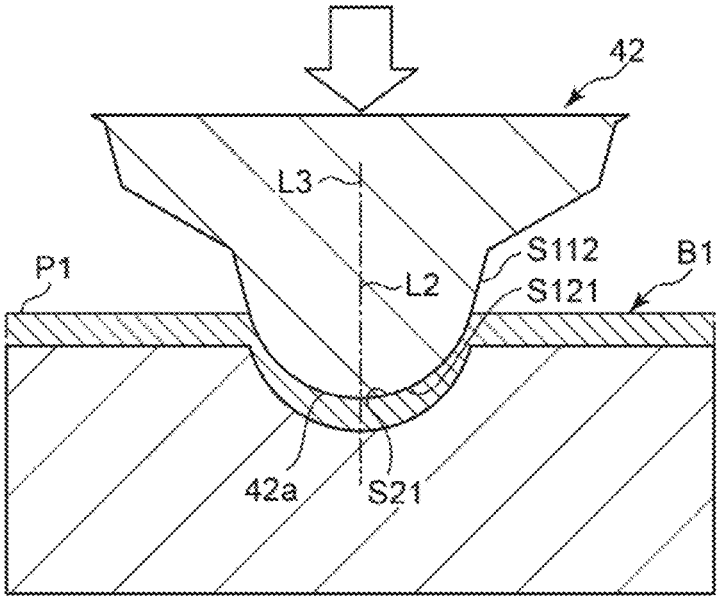
FIG. 10A is a partial enlarged view with the first surface of the punch in FIG. 9 holding down the plating of the bar-shape member.

As illustrated in FIG. 10A, the first surface S121 formed on the front end portion 42*a* of the punch 42 is the protruding circular arc surface. Hence, when the front end of the punch 42, that is, the portion of the concavity 22 that becomes the groove bottom 223 in FIG. 8A is viewed microscopic, such a front end is a plane, and thus when the front end enters the bar-shape member B1, the plating P1 is pushed in without causing a peeling. In addition, since the curved line formed from the planer portion at the front end of the punch 42 to the second surface S112 is also a protruding circular arc surface formed so as to have an angle of greater than 45 degrees and equal to or smaller than 90 degrees relative to the virtual reference line L2, the plating P1 is held down gently. Therefore, the plating P1 is pushed in without causing a peeling, and thus the first surface S21 of the concavity 22 is formed.

Figure 10B:
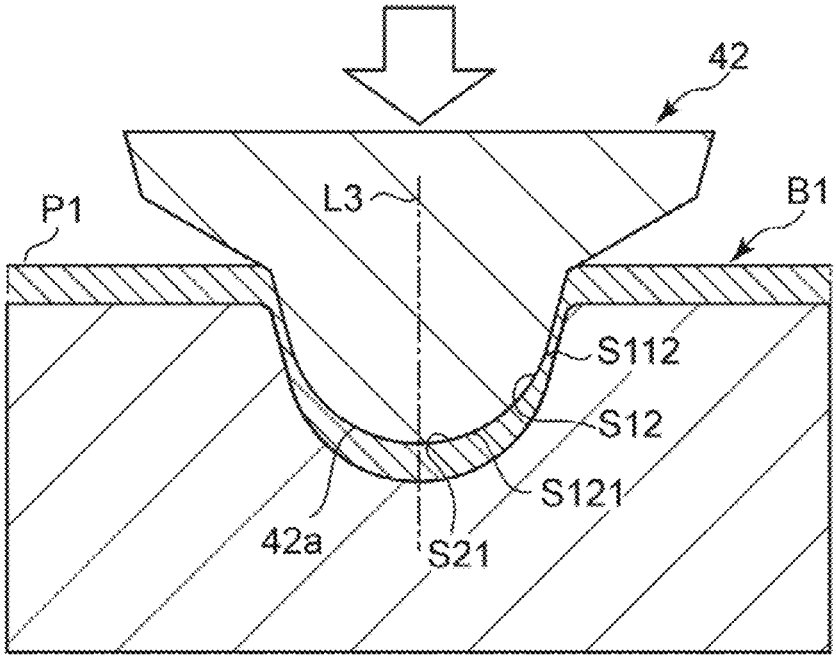
FIG. 10B is a partial enlarged view with a second surface of the punch holding down the plating of the bar-shape member subsequent to FIG. 10A.
Figure 10C:
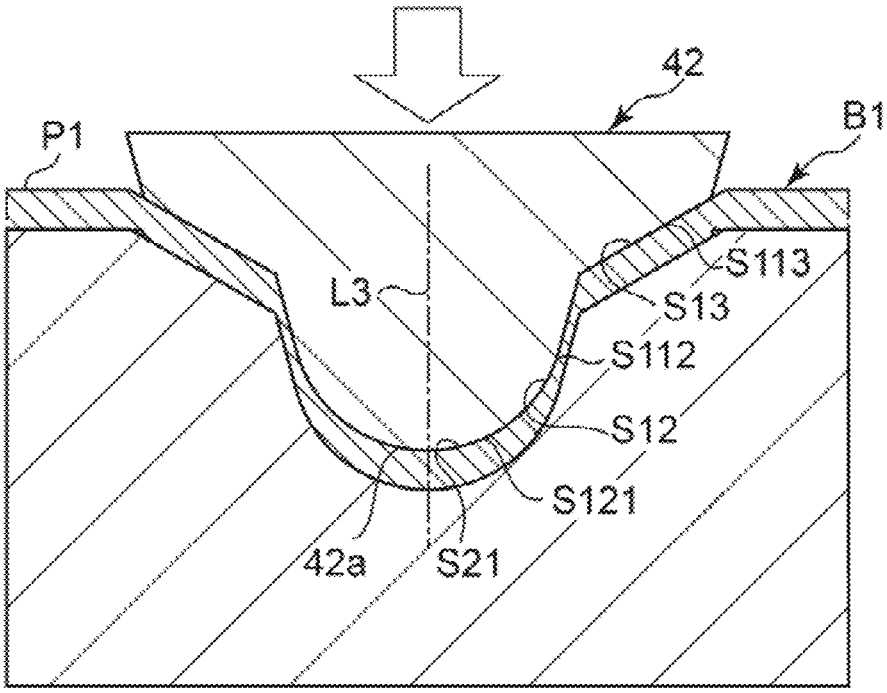
FIG. 10C is a partial enlarged view with a third surface of the punch holding down the plating of the bar-shape member subsequent to FIG. 10B.

Next, as illustrated in FIG. 10B, the second surface S112 of the punch 42 depresses the plating P1 of the bar-shape member B1, and the second surface S12 of the concavity 22 is formed. In addition, as illustrated in FIG. 10C, the third surface S113 of the punch 42 depresses the plating P1 of the bar-shape member B1, and thus the third surface S13 is formed.

As explained above, according to the second embodiment, the first surface S21 formed as a concaved circular arc surface is capable of suppressing a peeling of the plating P1 on the first surface S21, thereby suppressing a sticking of the plating peeled piece on the punch 42. Hence, the number of maintenance works for the punch 42 can be reduced. In addition, a short-circuit between the adjoining connector terminals 12 caused by the plating peeled piece can be suppressed.

Third Embodiment

A connector terminal according to a third embodiment of the present disclosure will be explained with reference to FIGS. 11-13C. In order to facilitate understanding, an XYZ coordinate system is set up and is referred as needed.

The connector terminal of the third embodiment has the first surface that is a flat surface which forms an angle of 90 degrees relative to the virtual reference line.

Figure 11:
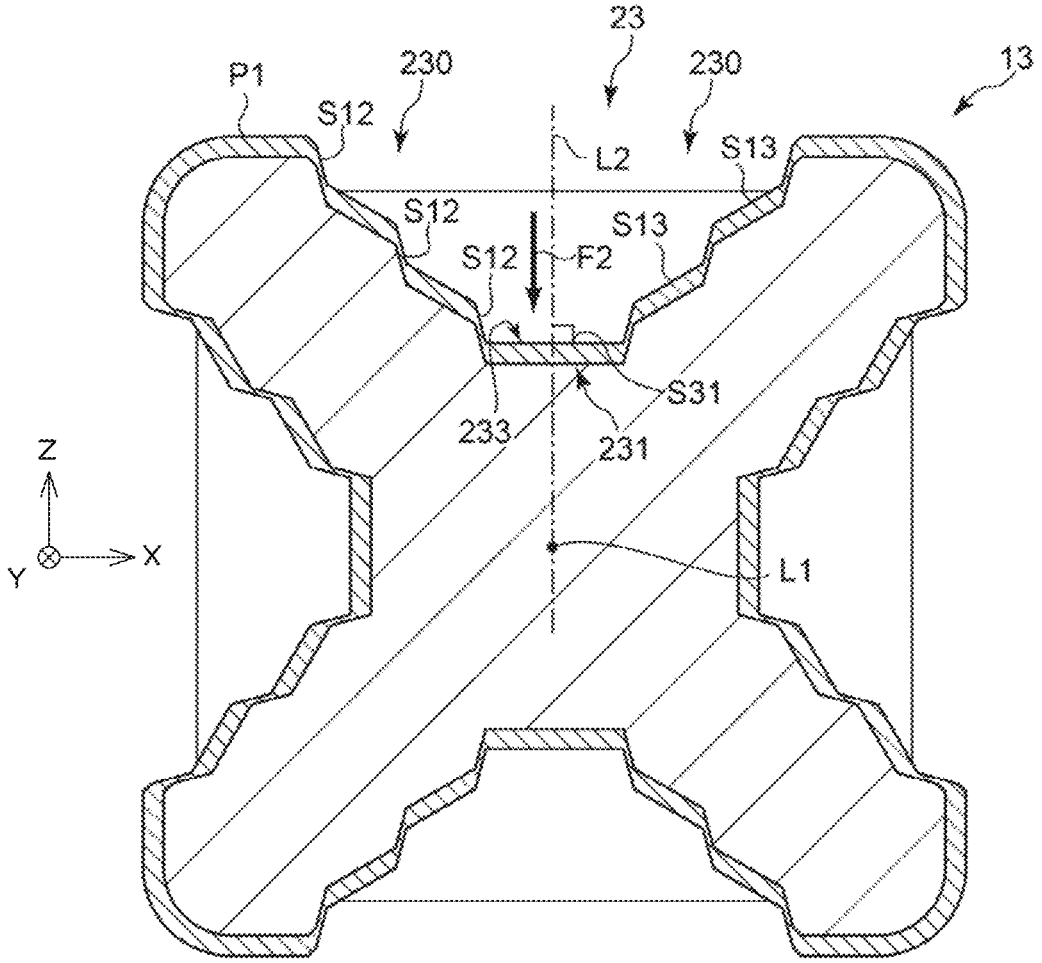
FIG. 11 is a cross-sectional view of a connector terminal according to a third embodiment of the present disclosure.

As illustrated in FIG. 11, a first surface S31 that forms a bottom 231 of an internal wall surface 230 is formed in a concavity 23 of a connector terminal 13. This first surface S31 will be explained in more detail.

Like the first and second embodiments, in the orthogonal XZ cross-section of the concavity 23 to the internal wall surface 230 of the concavity 23, a straight line toward the deepest portion of the concavity 23 in the depthwise direction F2 is defined as the virtual reference line L2. In the case of the internal wall surface 230 illustrated in FIG. 11, the deepest portion becomes a groove bottom 233.

The first surface S31 is a flat surface that forms an angle of 90 degrees relative to the virtual reference line L2. In FIGS. 8A and 8B, although the virtual reference line L2 passes through the axial line L1, the present disclosure is not limited to this case. The virtual reference line L2 may be shifted from but in parallel with the axial line L1.

Like the first and second embodiments, the first surface S31 is connected to the second surface S12. The second surface S12 is connected to the third surface S13. In addition, the second surface S12 and the third surface S13 are formed alternately toward an opening 232 of the concavity 23.

Figure 12:
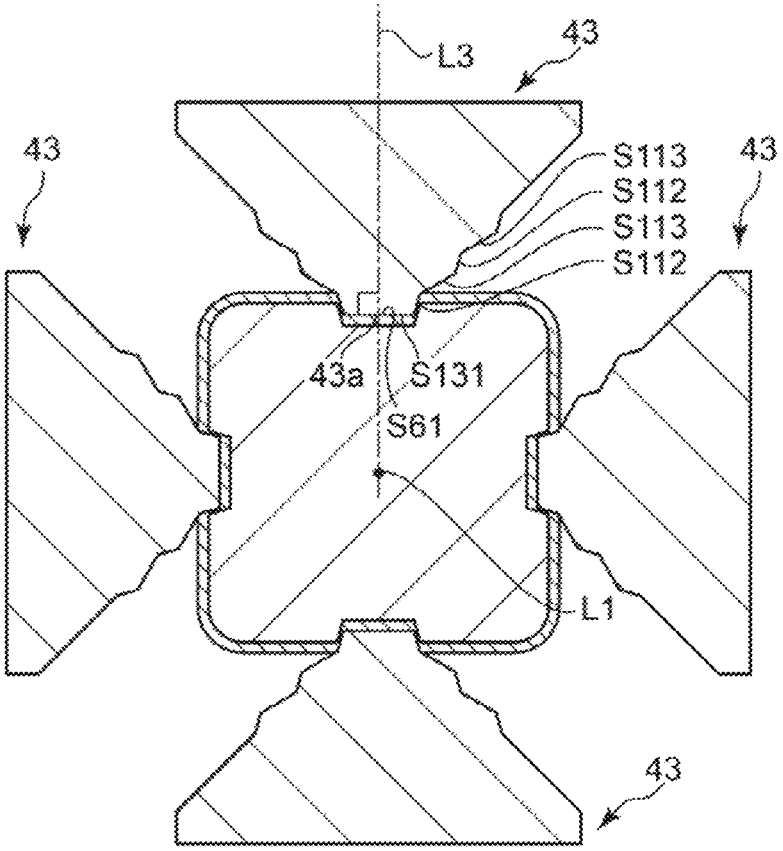
FIG. 12 is a cross-sectional view for explaining the production method of the connector terminal according to the third embodiment, and is a cross-sectional view with a first surface of a punch holding down a plating of a bar-shape member.

The concavity 23 is formed by a punch 43 illustrated in FIG. 12.

The punch 43 is formed with a first surface S131 to form the first surface S31 of the concavity 23. The first surface S131 is a flat surface that forms an angle of 90 degrees relative to the virtual reference line L3 which is a bisector that divides the angle of the front end portion 43*a* of the punch 43 equally.

Figure 13A:
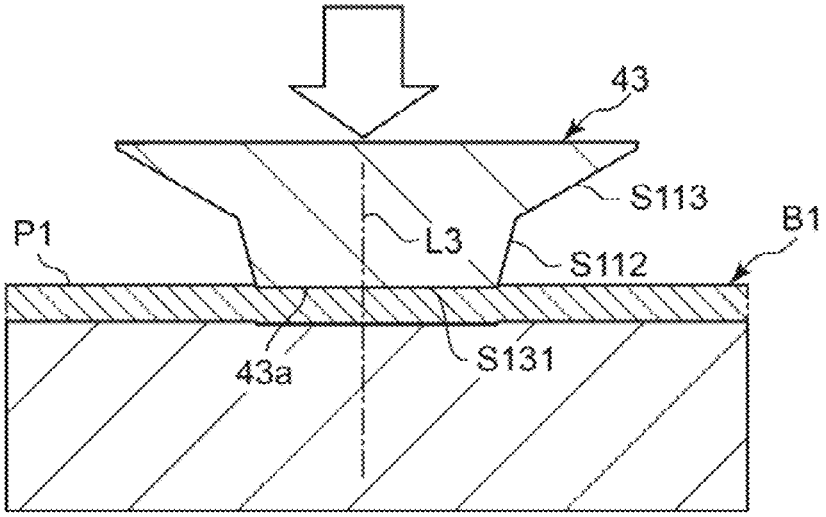
FIG. 13A is a partial cross-sectional view with the first surface of the punch in FIG. 12 abutting the plating of the bar-shape member.

As illustrated in FIG. 13A, using such a punch 43, the front end portion 43*a* is caused to abut, toward the axial line L1 of the bar-shape member B1, each surface of the bar-shape member B1 around the axial line L1 so as to have the vertical virtual reference line L3 to each surface, thereby depressing the plating P1.

The first surface S131 is a flat surface. Hence, when the first surface S131 of the punch 43 enters the bar-shape member B1, the plating P1 is straightly pushed in without causing a peeling, and thus the first surface S31 of the concavity 23 is formed.

Figure 13B:
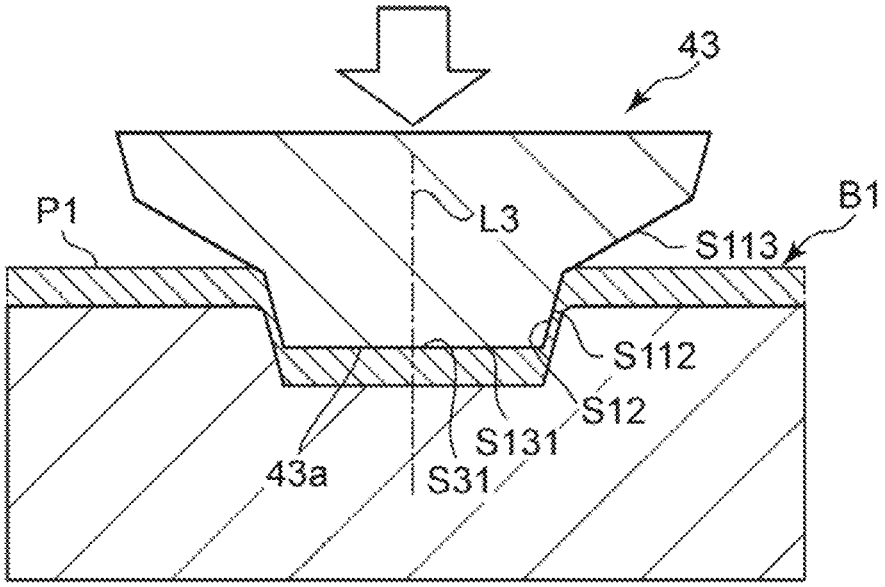
FIG. 13B is a partial enlarged cross-sectional view with a second surface of the punch holding down the plating of the bar-shape member subsequent to FIG. 13A.
Figure 13C:
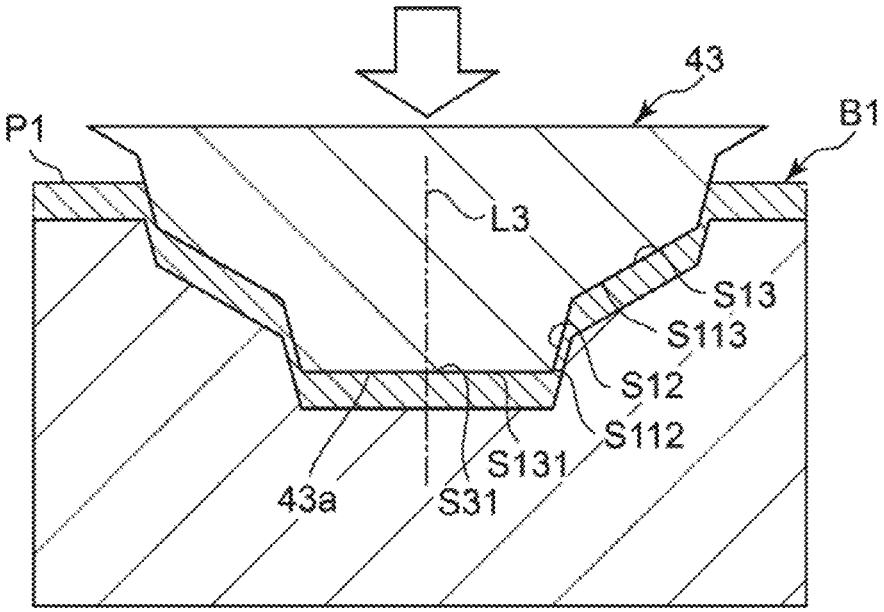
FIG. 13C is a partial enlarged cross-sectional view with a third surface of the punch holding down the plating of the bar-shape member subsequent to FIG. 13B.
Figure 14:
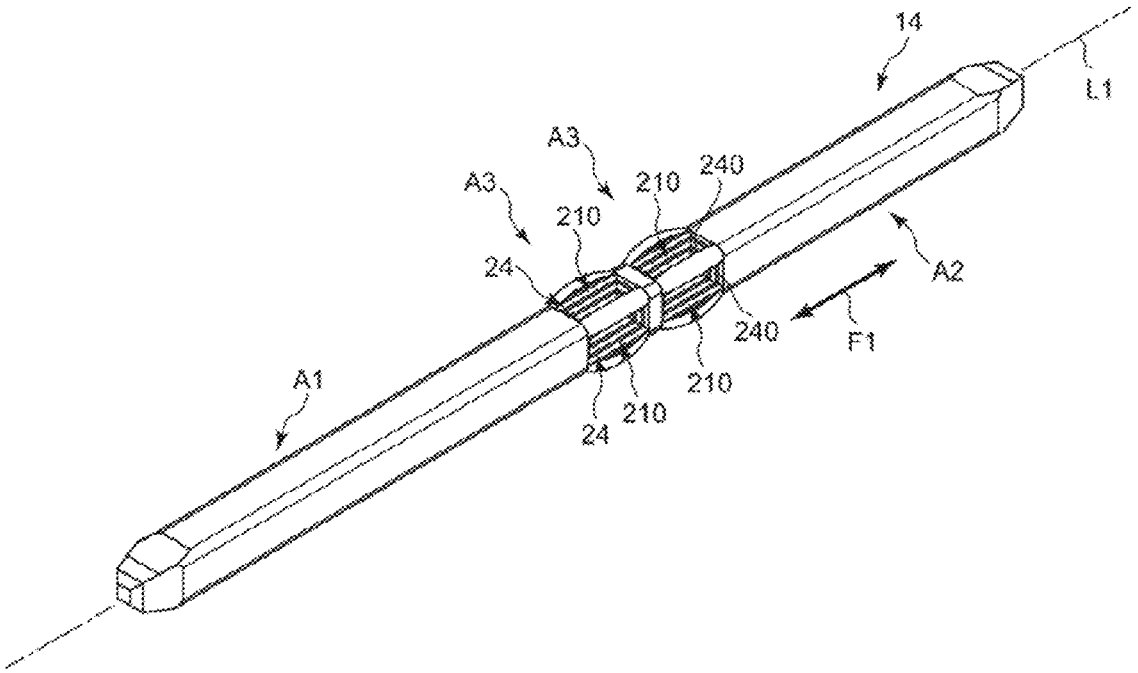
FIG. 14 is a perspective view illustrating a connector terminal according to a fourth embodiment of the present disclosure.
Figure 15:
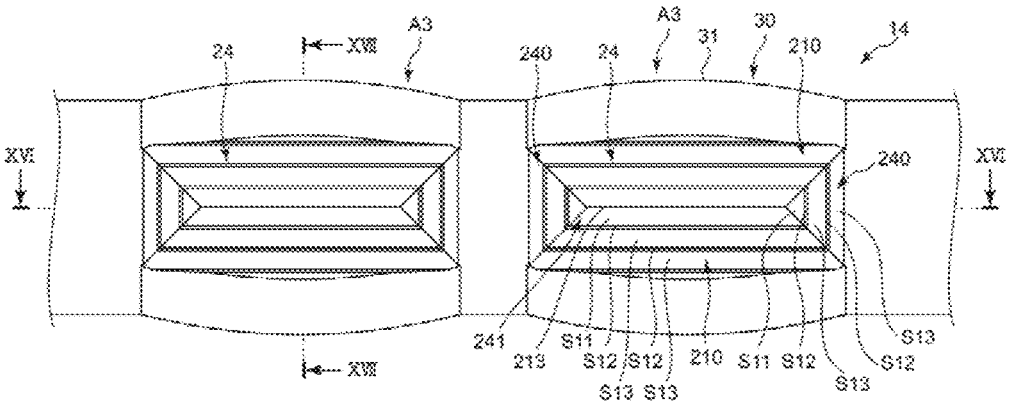
FIG. 15 is a plan view illustrating a portion of the connector terminal in an enlarged manner according to the fourth embodiment.
Figure 16:
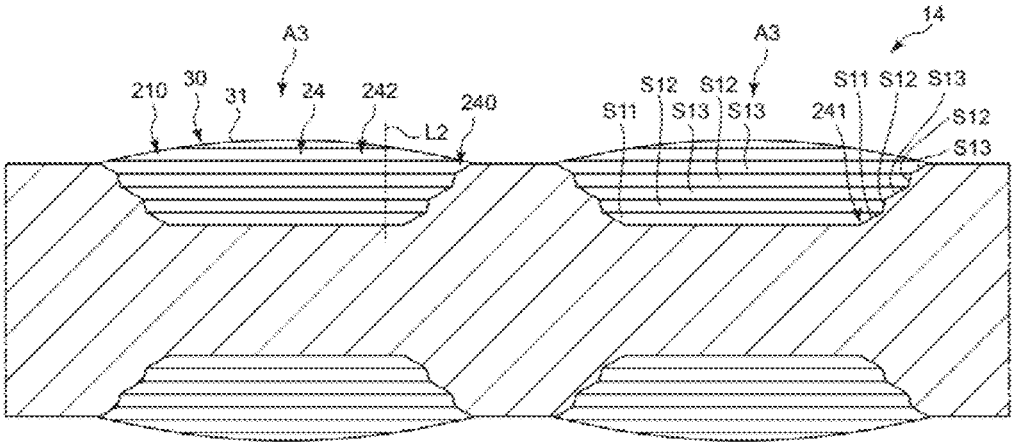
FIG. 16 is a cross-sectional view taken along a line XVI-XVI in FIG. 15.

Next, as illustrated in FIG. 13B, the second surface S112 of the punch 43 depresses the plating P1 of the bar-shape member B1, and thus the second surface S12 of the concavity 23 is formed. In addition, as illustrated in FIG. 13C, the third surface S113 of the punch 43 depresses the plating P1 of the bar-shape member B1, and thus the third surface S13 is formed.

As explained above, according to the third embodiment, the first surface S31 that is formed as a flat surface suppresses a peeling of the plating P1 on the first surface S31, thereby suppressing a sticking of the plating peeled piece on the punch 43. Hence, the number of maintenance works for the punch 43 can be reduced. In addition, a short-circuit between the adjoining connector terminals 13 caused by the plating peeled piece can be suppressed.

Fourth Embodiment

A connector terminal according to a fourth embodiment of the present disclosure will be explained with reference to FIGS. 14-17.

A connector terminal according to the fourth embodiment differs from those of the above embodiments in that steps are formed in not only the internal wall surface that is a parallel flat surface in the lengthwise direction of the bar-shape member but also an internal wall surface that is an orthogonal surface to the lengthwise direction.

Like the first embodiment, the first surface S11, the second surface S12, and the third surface S13 are formed on the internal wall surface 210 of a concavity 24 of the connector terminal 14. In addition, an internal wall surface 240 that is an orthogonal surface to the lengthwise direction F1 of the concavity 24 of the connector terminal 14 is formed so as to become widespread from a bottom 241 toward an opening 242. Like the internal wall surface 210, steps are formed in the internal wall surface 240 by the first to third surfaces S11 to S13.

The first to third surfaces S11 to S13 formed on the internal wall surface 240 have the same conditions as those defined for the first to third surfaces S11 to S13 on the internal wall surface 210 in the first embodiment.

As explained above, according to the fourth embodiment, the respective first surfaces S11, second surfaces S12, and third surfaces S13 are formed on the internal wall surfaces 210, 240. Hence, when the internal wall surface 210 of the concavity 24 is to be formed by the punch, a peeling of the plating P1 in the orthogonal direction to the lengthwise direction is suppressed, and when the internal wall surface 240 is to be formed by the punch, a peeling of the plating P1 in the lengthwise direction is also suppressed. Hence, a sticking of the plating peeled piece on the punch can be further suppressed, and thus the number of maintenance works for the punch can be further reduced. In addition, a short-circuit between the adjoining connector terminals 14 caused by the plating peeled piece can be suppressed.

Figure 17:
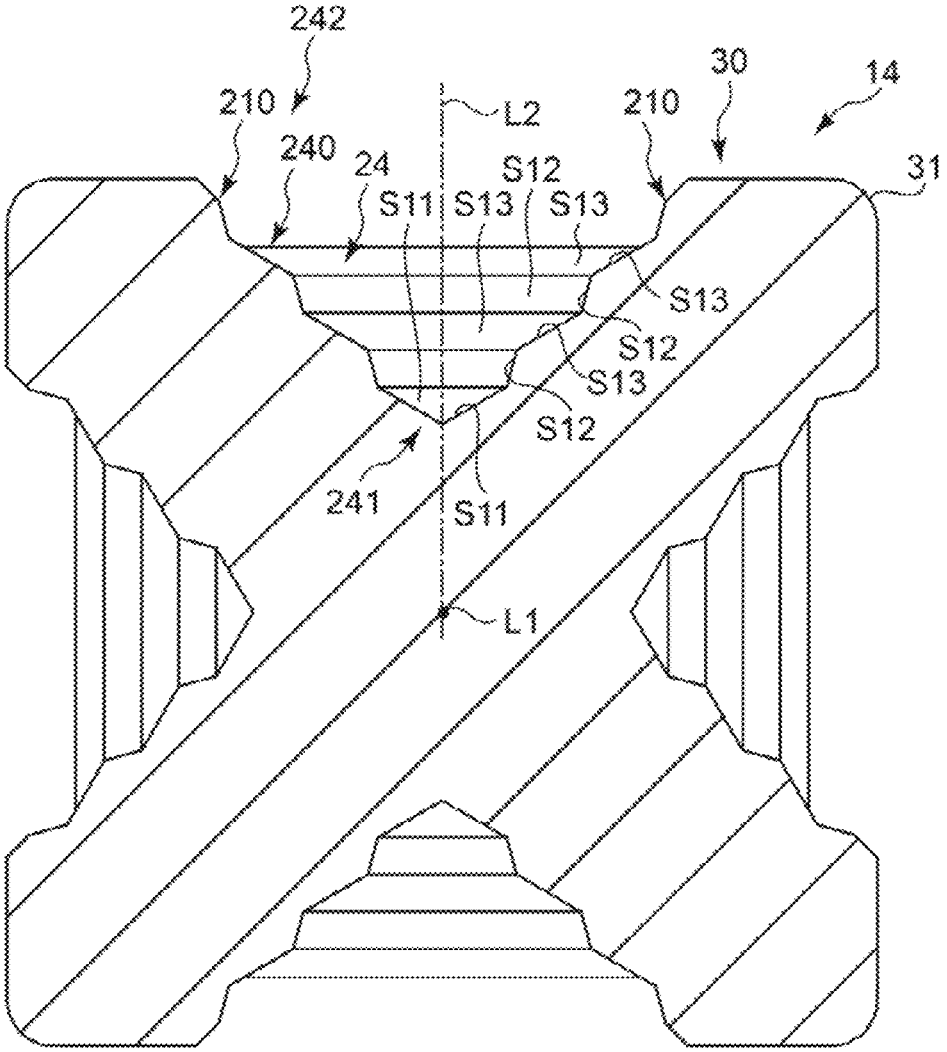
FIG. 17 is a cross-sectional view taken along a line XVII-XVII in FIG. 15.

According to the connector terminal 14 in the fourth embodiment, the first surface S11 of the internal wall surface 210 is formed as an inclined flat surface relative to the virtual reference line L2 as illustrated in FIG. 17. However, the first surface S11 of the internal wall surface 210 may be a concaved circular arc surface like the first surface S21 (see FIG. 8) of the internal wall surface 220 in the second embodiment, or may be a flat surface that forms an angle of 90 degrees relative to the virtual reference line L2 like the first surface S31 (see FIG. 11) of the internal wall surface 230 in the third embodiment.

In this case, the internal wall surface 240 may be an inclined flat surface (first surface S11) relative to the virtual reference line L2 illustrated in FIG. 17, a concaved circular arc surface (first surface S21) illustrated in FIGS. 8A, 8B, or may be the flat surface (first surface S31) that forms an angle of 90 degrees relative to the virtual reference line L2 in FIG. 11, thus combined with the first surfaces S11, S21, S31 of the internal wall surfaces 210, 220, 230.

In the first to fourth embodiments, the subsequent surface to the first surfaces S11, S21, S31 is the second surface S12, but may be a flat surface that includes the third surface S13 with a different angular condition from that of the second surface S12 relative to the virtual reference line L2, or may be a circular arc surface. In the first to fourth embodiments, since the second surface S12 is disposed subsequent to the first surfaces S11, S21, S31, the first surfaces S11, S21, S31 and the third surface S13 where the plating P1 is pushed down, and the second surface S12 where the plating is thinned and elongated and which deeply concaved in the bar-shape member B1 can be disposed alternately. Hence, each surface can be disposed as appropriate.

In addition, in the first to fourth embodiments, the orthogonal XZ cross-section to the lengthwise direction F1 of the bar-shape member B1 is a square bar-shape member, but may be a triangular, pentagonal or greater bar-shape member, or a bar-shape member with a polygonal cross-section. In this case, by depressing the punch against each surface around the axial line to form the concavity, the concavities 21-24 can be uniformly formed in the bar-shape member. This prevents the bar-shape member from rolling around the axial line L1 due to the depressing force from the punch.

Figure 18A:
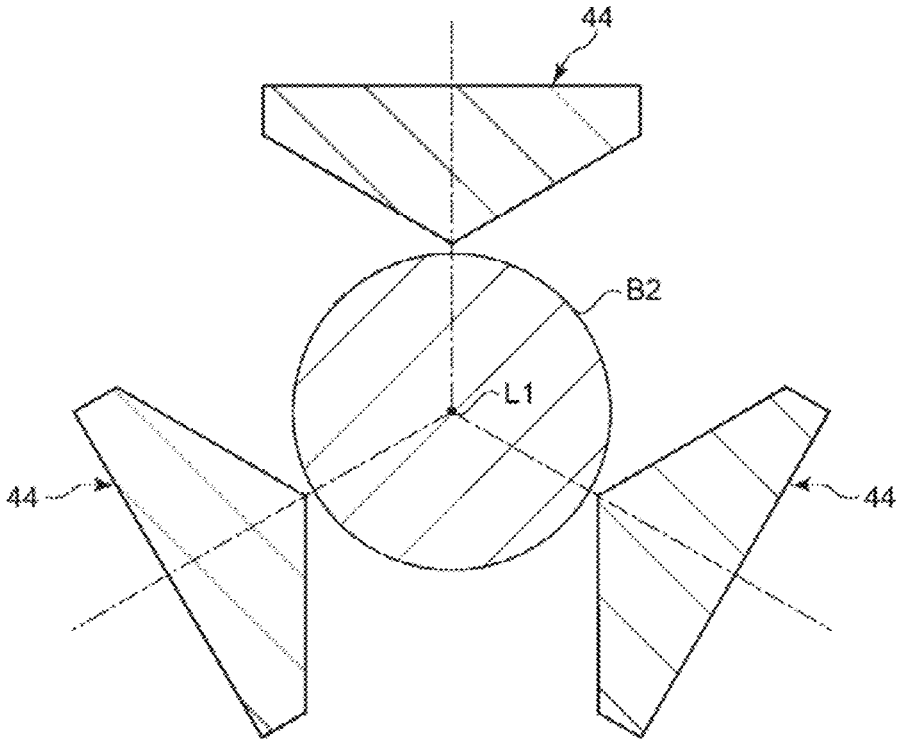
FIG. 18A is a cross-sectional view for explaining the production method of a connector terminal according to a first modified example, and is a cross-sectional shape with punches being disposed around a bar-shape member that has a circular cross-section.
Figure 18B:
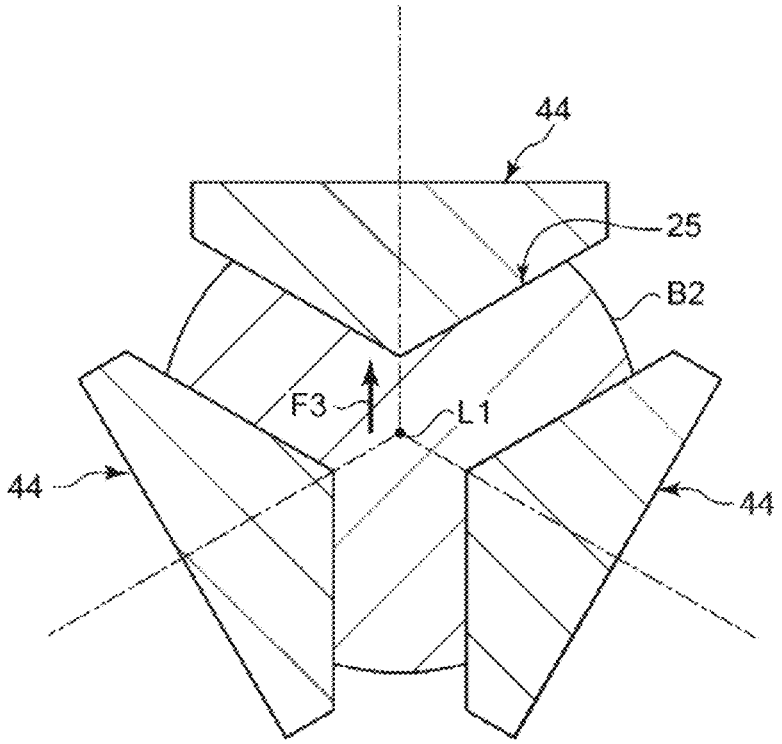
FIG. 18B is a cross-sectional view with the bar-shape member in FIG. 18A being depressed by the punch.

Still further, as illustrated in FIG. 18A, a bar-shape member B2 may have a circular cross-section. In FIGS. 18A and 18B, illustration of the continuous steps formed by the first surface to the third surface on the punch 44 and that of the plating on the bar-shape member B2 are omitted.

In this case, since a concavity 25 illustrated in FIG. 18B is formed from the axial line L1 of the bar-shape member B2 toward a radial direction F3, the bar-shape member B2 is prevented from rolling around the axial line L1 by the depressing force from a punch 44. Moreover, since the concavities 25 are formed at positions equally dividing the circumference, the concavities 25 can be formed uniformly in the bar-shape member B2.

Figure 19:
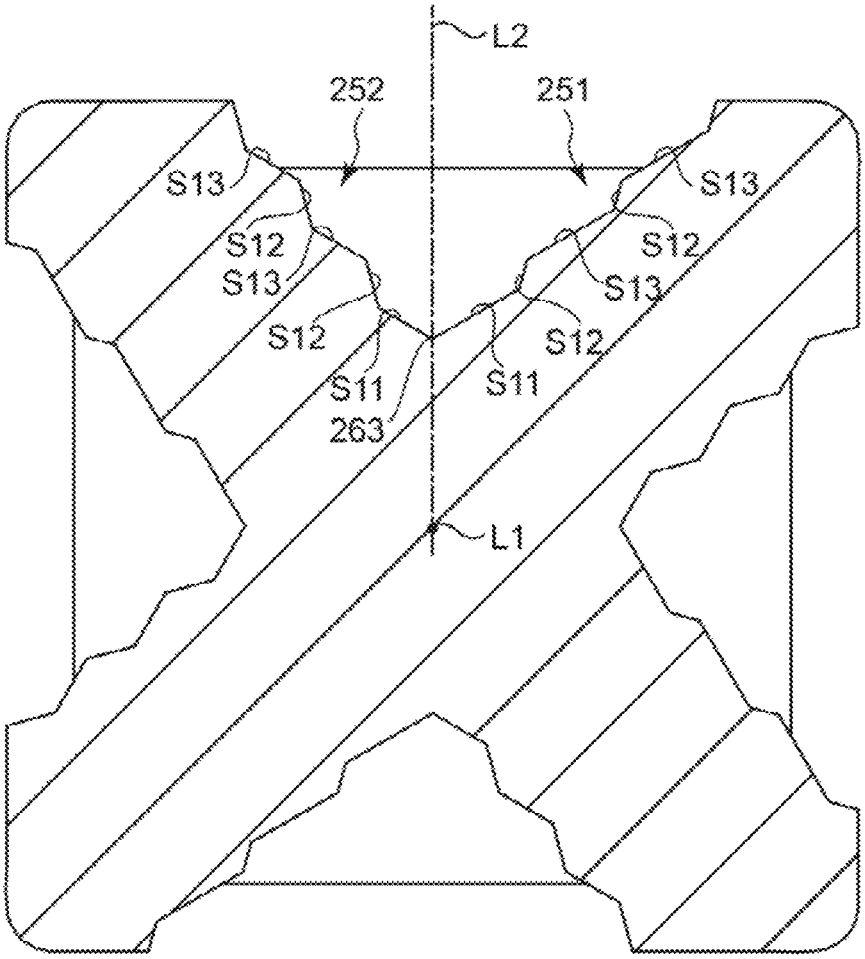
FIG. 19 is a cross-sectional view of a connector terminal according to a second modified example, and is a cross-sectional view for explaining a condition in which the internal wall surface of a concavity is not symmetrical relative to a virtual reference line.
Figure 20:
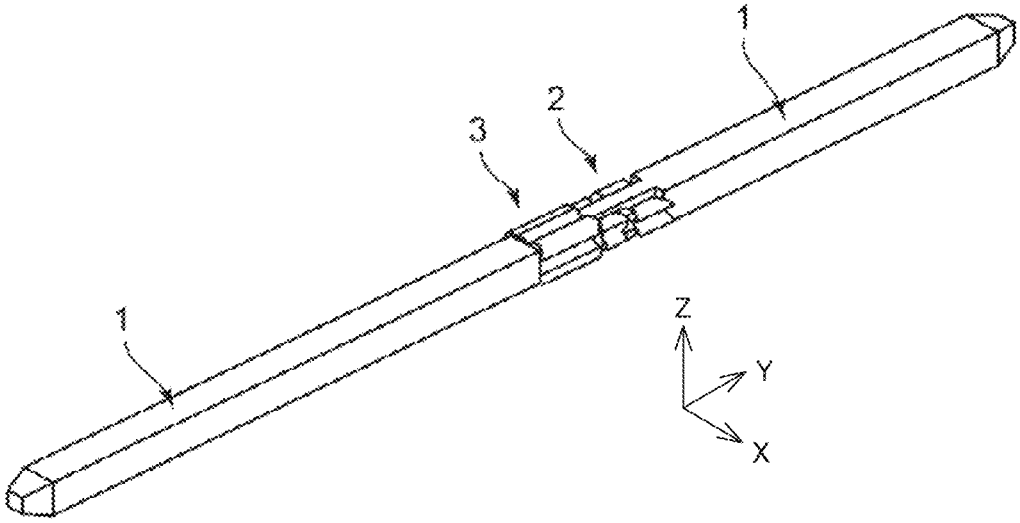
FIG.20 PRIOR ART
FIG. 20 is a perspective view illustrating a connector terminal disclosed in Unexamined Japanese Patent Application Kokai Publication No. 2014-203627.
Figure 21:
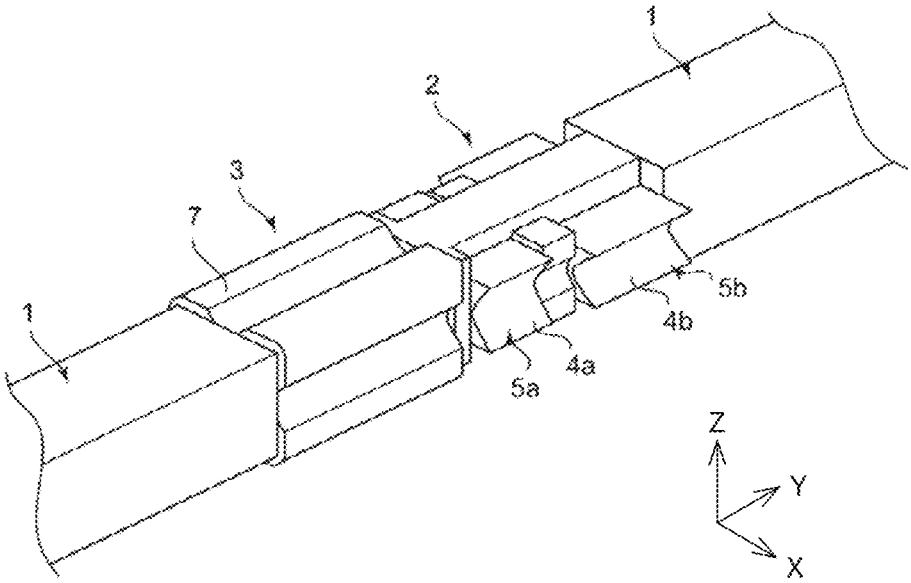
FIG.21 PRIOR ART
FIG. 21 is an enlarged cross-sectional view of an engage portion of the connector terminal in FIG. 20.
Figure 22:
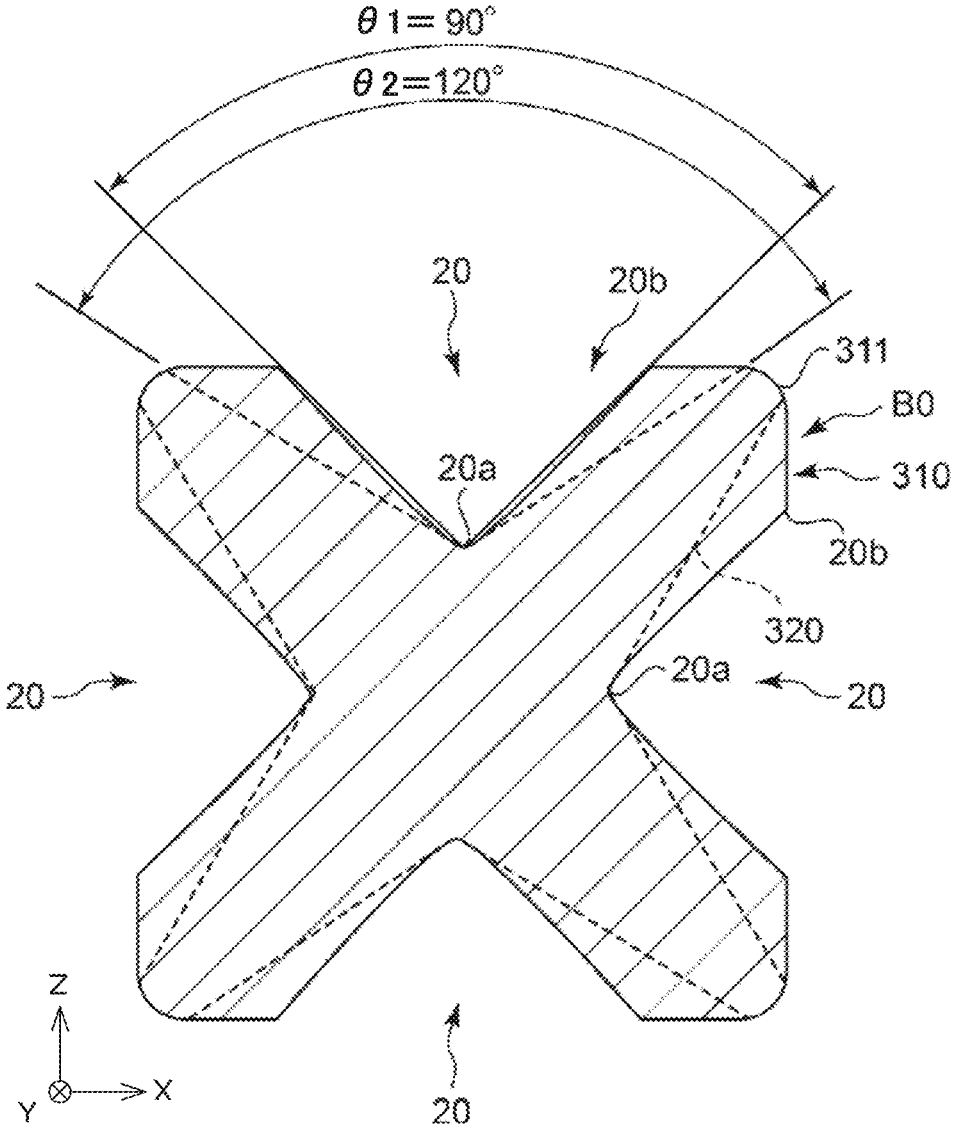
FIG.22 PRIOR ART
FIG. 22 is a cross-sectional view illustrating another conventional connector terminal.

Yet still further, according to the first to fourth embodiments, the concavities 21-24 are formed line-symmetrical relative to the virtual reference line L2 as the symmetrical line, but as illustrated in FIG. 19, as for a concavity 26, an internal wall surface 252 is a keen inclined face in comparison with an internal wall surface 251 that is a gentle inclined face. Hence, the concavity 26 is non-symmetrical. However, by setting a straight line in the depthwise direction F2 toward the deepest portion (groove bottom 263) of the concavity 26 as the virtual reference line L2, the first to third surfaces S11-S13 can be defined.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

What is claimed is:

1. A connector terminal comprising:

a conductive bar-shape member;

a plurality of concavities each formed as a groove provided in an outer circumference of the bar-shape member, extending in a lengthwise direction of the bar-shape member, and spreading toward an opening from a bottom; and a convexity formed between the adjoining concavities, wherein:

a first surface is formed on the bottom of the concavity; and a second surface and a third surface that form different inclination angles relative to a depthwise direction of the concavity are alternately formed on an internal wall surface of the concavity from the bottom toward the opening.

2. The connector terminal according to claim 1, wherein when, in a cross-section of the concavity orthogonal to the lengthwise direction of the bar-shape member, a parallel straight line to the depthwise direction of the concavity is defined as a virtual reference line:

an angle between the first surface and the virtual reference line is greater than 45 degrees and equal to or smaller than 90 degrees;

an angle between the second surface and the virtual reference line is equal to or greater than zero degree and equal to or smaller than 45 degrees; and an angle between the third surface and the virtual reference line is greater than 45 degrees and equal to or smaller than 90 degrees.

3. The connector terminal according to claim 2, wherein the first surface is a concaved circular arc surface, a flat surface that forms an angle of 90 degrees relative to the virtual reference line, or a flat surface inclined relative to the virtual reference line.

4. The connector terminal according to claim 1, wherein the internal wall surface of the concavity is a parallel surface to the lengthwise direction of the bar-shape member.

5. The connector terminal according to claim 1, wherein the internal wall surface of the concavity is an orthogonal surface to the lengthwise direction of the bar-shape member.

6. The connector terminal according to claim 4, wherein the second surface is connected to the first surface.

7. The connector terminal according to claim 1, wherein an area of the second surface is smaller than an area of the third surface.

8. The connector terminal according to claim 1, wherein the bar-shape member is formed in a polygonal cross-sectional shape.

9. The connector terminal according to claim 1, wherein the bar-shape member is formed in a circular cross-sectional shape.

10. The connector terminal according to claim 8, wherein the concavity is formed in a position that equally divides a circumference.

11. A connector comprising:

a housing formed with a connector terminal housing space; and the connector terminal according to claim 1 disposed in the connector terminal housing space, wherein the connector terminal allows the convexity to be engaged with an internal surface of the housing, thereby being fastened to the connector terminal housing space.

12. The connector according to claim 11, wherein the convexity bites in the internal surface of the housing, thus being fastened.

* * * * *